US005349264A

United States Patent [19]

Krings

[11] Patent Number: 5,349,264

[45] Date of Patent: Sep. 20, 1994

[54] ELECTRIC LAMP CONSTRUCTION HAVING A CONTACT TONGUE SECURELY FIXED BY AN INSULATOR BODY IN A SLEEVE

[75] Inventor: Wilfried H. Krings, Wurselen, Fed. Rep. of Germany

[73] Assignee: U.S. Philips Corporation, New York, N.Y.

[21] Appl. No.: 911,560

[22] Filed: Jul. 8, 1992

[30] Foreign Application Priority Data

Nov. 11, 1991 [EP] European Pat. Off. ..... 91202923.8

[51] Int. Cl.[5] ..... H01J 5/48; H01J 5/50; H01R 13/64

[52] U.S. Cl. ..... 313/318; 313/49; 313/50; 439/375; 439/616

[58] Field of Search ..... 313/318, 50, 49; 439/375, 616

[56] References Cited

U.S. PATENT DOCUMENTS 1,982,319 11/1934 Perry ..... 313/50
4,714,858 12/1987 Sanders ..... 313/318

FOREIGN PATENT DOCUMENTS 2093632 1/1982 United Kingdom .

*Primary Examiner*—Donald J. Yusko
*Assistant Examiner*—Matthew J. Esserman
*Attorney, Agent, or Firm*—Paul R. Miller

[57] ABSTRACT

An electric lamp has a lamp vessel provided with a seal, fixed to a first end of a metal sleeve. In a second end of the sleeve an insulator body through which a contact member extends is rigidly secured. To that end the inner channel of the sleeve has a constriction cooperating with the insulator body at a second end face thereof, and an inward projection from the sleeve into a recess in a side face of the insulator body. The recess extends to a first end face of the insulator body. The lamp is of an easily producible construction.

10 Claims, 1 Drawing Sheet

ELECTRIC LAMP CONSTRUCTION HAVING A CONTACT TONGUE SECURELY FIXED BY AN INSULATOR BODY IN A SLEEVE

The invention relates to an electric lamp comprising:

a lamp vessel which is sealed in a gaslight manner and in which an electric element is accommodated, which element is connected to first and second current conductors issuing to the exterior through a seal of the lamp vessel;

a substantially rectangular metal sleeve which is fixed with a first end portion around the seal and which is electrically connected to the first current conductor;

an insulator body provided with side faces and first and second end faces fixed in a second end portion of the sleeve;

a contact tongue fixed in the insulator body, which tongue runs from outside the sleeve through the insulator body via the end faces and is connected to the second current conductor inside the sleeve;

the insulator body having a recess in a side face in which an inward projection of the sleeve is accommodated.

BACKGROUND OF THE INVENTION

Such an electric lamp is known from British Patent Application No. GB 2 093 632 A and can be used as a vehicle headlamp. The lamp may be constructed, for example, as an H-1 lamp and have an incandescent body arranged in the direction of the sleeve inside the lamp vessel in a halogen-containing gas.

The insulator body of the known lamp has a hole in a side face between the end faces, which hole runs on to the opposing side face and into which the sleeve enters with an inward projection so as to fix the insulator body in the sleeve.

Since the formation of such a hole necessitates a more expensive, multiple mould for the manufacture of the insulator body, it is more attractive in the case of an insulator body made of synthetic resin to provide the hole therein by drilling after the manufacture of the body. The use of synthetic resin, however, involves a risk, i.e. when the lamp is used in an optical system, for example a reflector, volatile components originating from the resin may be deposited in that system and pollute it. This is why a ceramic insulator body is preferred.

A disadvantage of the ceramic insulator body of the known lamp is that a multiple mould is necessary for manufacturing the insulator body. This is because it is not possible to provide a hole in a formed ceramic body in an industrially attractive manner afterwards.

SUMMARY OF THE INVENTION

It is an object of the invention to provide an electric lamp of the kind mentioned in the opening paragraph which has a construction that is easy to manufacture. In particular, it is an object to provide such an electric lamp which has an insulator body which is easier to manufacture.

According to the invention, this object is achieved in that a recess in the insulator body extends from the first end face and the sleeve has a constriction which cooperates with the insulator body at the second end face, the inward projection and the constriction together keeping the insulator body securely fixed in the sleeve.

Since the recess in the lamp according to the invention extends from the first end face, the insulator body can be manufactured in a simple, two-part mould of which the mould part forming the first end face also forms the recess. The continuation of the recess from the first end face, however, means that the inward projection of the sleeve forms a stop for the insulator body in one direction only. Therefore, a constriction is present in the sleeve which cooperates with the insulator body near the second end face in order to block this body in the opposite direction.

The recess may extend away from the first end face only so far that the inward projection lies at the end of the recess.

In a favourable embodiment, the recess is a hole through the insulator body. The recess then continues up to the side of the contact tongue. In an alternative embodiment, the insulator body has a corresponding recess in each of two opposing side faces. In a modification of this embodiment, the insulator body has a recess opening which runs as a hole from one side face into an opposing side face. The inward projection of the sleeve may then be made to project into each of these opposing side faces. An opening through the insulator body has an advantage over a shallow recess since the tools with which an inward projection is made can perform a larger stroke during this operation, so that the wall of the sleeve during making of the projection is broken through and so that little elastic deformation of the sleeve, and thus a very secure coupling are obtained.

It is also favourable to give the contact tongue at the area of the inward projection an opening or a hole which is wider than this projection, for example, wider than the recess in the insulator body. This opening may be, for example, semi-circular. This opening also increases the stroke of the deforming tool and ensures that the sleeve with the projection does not touch the contact tongue.

The constriction of the sleeve may be realised in various ways, for example, by means of a tag bent inwardly from the sleeve or conveniently, however, by means of indentation, or several indentations. In a favourable embodiment, the insulator body a second recess in a side face near the second end face, which second recess cooperates with constriction. A sufficient spacing between the contact tongue and the constriction is then ensured.

The first end face of the insulator body may lie inside the sleeve, but it is favourable if the second end face is situated there. The sleeve may then be provided with the constriction beforehand and the inward projection may be provided for fixing after the sleeve and the insulator body have been joined together.

The contact tongue may be fixed in the insulator body in various ways, for example, by extending a flattened contact tongue through the insulator body in a known manner, such as seen in GB 2,093,632A;

BRIEF DESCRIPTION OF THE DRAWING FIGURES

An embodiment of the electric lamp according to the invention is shown in the drawing, in which FIG. 1 shows a lamp in side elevation;

DESCRIPTION OF THE INVENTION

Figure 1:
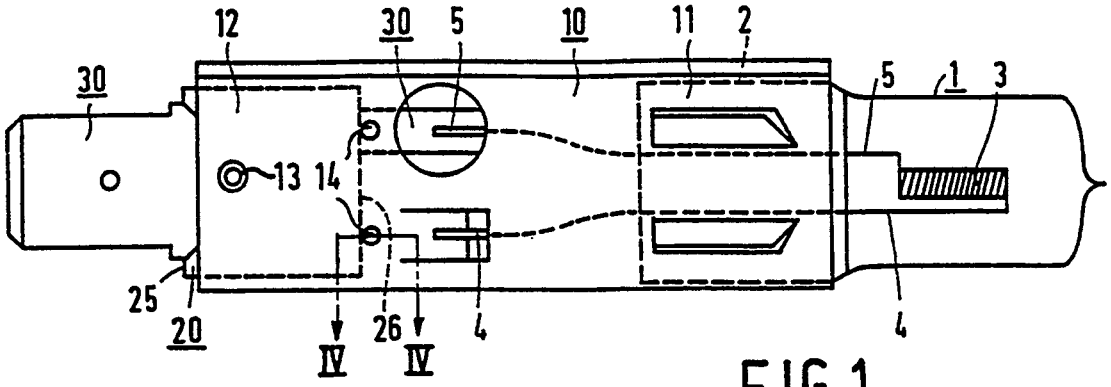

In FIG. 1, the electric lamp has a lamp vessel 1 which is sealed in a gastight manner and in which an electric element 3 is accommodated. The lamp vessel includes an incandescent body, for example, having a halogen-containing gas, and the electric element is connected to first and second current conductors 4, 5 which issue to the exterior through a seal 2 of the lamp vessel. A substantially rectangular metal sleeve 10 is fixed with a first end portion 11 around the seal 2 and electrically connected to the first current conductor 4. An insulator body 20, provided with side faces 21–24 and first 25 and second 26 end faces (see FIG. 3) is fixed in a second end portion 12 of the sleeve 10. A contact tongue 30 which is fixed in the insulator body 20 runs from outside the sleeve 10 through the insulator body 20 via the end faces 25,26 and is connected to the second current conductor 5 inside the sleeve 10. The insulator body 20 has a recess 27 in a side face 21 (see FIG. 3) , into which an inward projection 13 of the sleeve 10 enters the recess .

Figure 4:
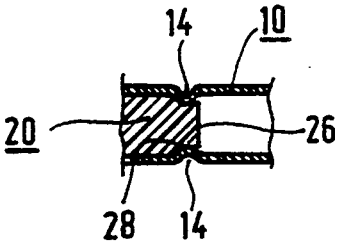
FIG. 4 shows the cross section IV—IV of FIG. 1.

The recess 27 in the insulator body 20 extends from first end face 25, and the sleeve 10 has a constriction 14, as seen in FIG. 4 which cooperates with the insulator body 20 near the second end face 26. The projection 13 and the constriction 14 keep the insulator body 20 securely fixed in the sleeve 10.

In FIG. 1 the second end face 26 lies inside the sleeve 10 and the first end face 25 outside it. In an alternative embodiment, this may be geometrically reversed.

Figure 2:
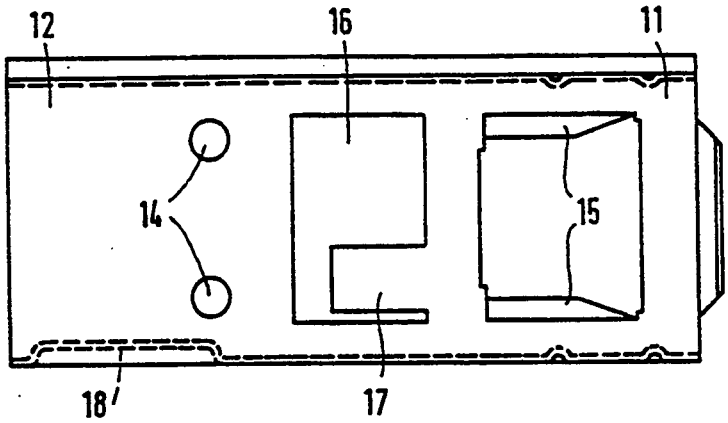
FIG 2 shows a modification of the sleeve of FIG. 1 in side elevation.

In FIG. 2, portions of the sleeve corresponding to portions in FIG. 1 have the same reference numerals. The first end portion 11 of the sleeve 10 has rigid, resilient tags 15 for gripping the seal 2 of the lamp vessel. In a window 16, mutually facing tongues 17 extend between which the first current conductor 4 (see FIG. 1) can be fixed by welding. Indentations 14 (see FIG. 4) forming a constriction of the sleeve are present for blocking the insulator body 20 against inward movement or shifting in the sleeve. An elongated depression 18 is present in the sleeve for pressing against a side face of the insulator body in order to fix the latter from sideways movement. An electrical connection of the second current conductor 5 (see FIG 1) with the contact tongue 30 may be made in the window 16.

Figure 3:
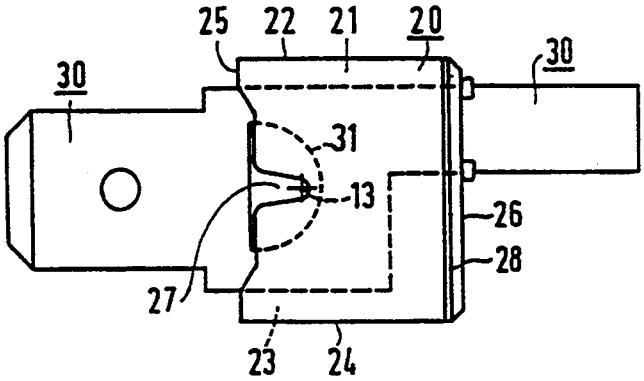
FIG. 3 shows the insulator body with the contact tongue of FIG. 1 in side elevation.

In FIG. 3, the recess 27 is an opening in the ceramic insulator body 20. An opening 27 is present in two opposing side faces 21, 23, so the body in the Figure has a continuous opening or hole from side face 21 to side face 23. Another hole 31 is present in the contact tongue 30 at the area of the inward projection 13, which hole is wider than the recess 27 at the area of the projection 13. The insulator body 20 has near its second end face 26 an inwardly recessed surface forming a second recess 28 which may cooperate with the constriction 14 shown in phantom by dotted lines of FIG. 3, of the sleeve 10.

The inward projection 13 in FIG. 1 is round. The recess 27 in FIG. 3, however, may extend only so far away from the end face 25 that the projection 13 lies at the end of the sleeve and is as a result, for example, semicircular.

I claim:

1. An electric lamp structure comprising (a) a lamp vessel enclosing an electric element, said lamp vessel being sealed in a gastight manner with a seal, said electric element being connected to first and second current conductors, each extending through said seal to an exterior of said lamp vessel;

(b) a substantially rectangular metal sleeve having a first end portion fixed about said seal, said rectangular sleeve being electrically connected to said first current conductor;

(c) a substantially rectangular insulator body having four side faces and a first and a second end face, said insulator body being fixed in a second end portion of said substantially rectangular metal sleeve, said insulator body having a recess in at least one side face extending from said first end face;

(d) a contact tongue fixed in said insulator body and extending from outside said metal sleeve beyond said first end face through said insulator body into said metal sleeve beyond said second end face, said contact tongue being electrically connected to said second current conductor inside said metal sleeve;

wherein a corresponding inward projection of said rectangular metal sleeve is accommodated in said recess and said metal sleeve has at lest one inward constriction cooperating with said second end face of said insulator body so as to securely fix said insulator body within said metal sleeve by said inward projection in said recess in one direction and by said inward constriction at said second end face in an opposite direction.

2. An electric lamp structure according to claim 1, wherein said recess is an opening in said insulator body extending from said at least one side face.

3. An electric lamp structure according to claim 2, wherein said recess is disposed in two opposite side faces of said insulator body.

4. An electric lamp structure according to claim 3, wherein said contact tongue has an opening at the area of said inward projection, said opening in said contact tongue being wider than said recess in said insulator body at the area of said inward projection of said metal sleeve.

5. An electric lamp structure according to claim 1, wherein said insulator body has a second recess near said second end face, said second recess cooperating with said inward constriction of said metal sleeve.

6. An electric lamp structure according to claim 5, wherein said inward constriction consists of at least one indentation.

7. An electric lamp structure according to claim 1, wherein said metal sleeve has an elongated inward depression pressing against a side face of said insulator body.

8. An electric lamp structure according to claim 2, wherein said contact tongue has an opening at the area of said inward projection, said opening in said contact tongue being wider than said recess in said insulator body at the area of said inward projection of said metal sleeve.

9. An electric lamp structure according to claim 1, wherein said recess is disposed in two opposite side faces of said insulator body.

10. An electric lamp structure according to claim 1, wherein said inward constriction consists of at least one indentation.

* * * * *